US009322417B2

(12) United States Patent
Su et al.

(10) Patent No.: US 9,322,417 B2
(45) Date of Patent: Apr. 26, 2016

(54) MOTOR ASSEMBLY FOR PNEUMATIC TOOL

(71) Applicant: BASSO INDUSTRY CORP., Taichung (TW)

(72) Inventors: San-Yih Su, Taichung (TW); Cheng-Wei Lai, Taichung (TW)

(73) Assignee: BASSO INDUSTRY CORP., Taichung (TW)

( * ) Notice: Subject to any disclaimer, the term of this patent is extended or adjusted under 35 U.S.C. 154(b) by 388 days.

(21) Appl. No.: 13/892,591

(22) Filed: May 13, 2013

(65) Prior Publication Data

US 2013/0298755 A1 Nov. 14, 2013

(30) Foreign Application Priority Data

May 14, 2012 (TW) ..... 101117097 A

(51) Int. Cl.
*B25F 5/00* (2006.01)
*F15B 15/00* (2006.01)
*B25F 5/02* (2006.01)

(52) U.S. Cl.
CPC ..... *F15B 15/00* (2013.01); *B25F 5/005* (2013.01); *B25F 5/02* (2013.01)

(58) Field of Classification Search
CPC ..... B25F 5/005
See application file for complete search history.

(56) References Cited

U.S. PATENT DOCUMENTS

| | | | | |
|---|---|---|---|---|
| 3,190,183 | A * | 6/1965 | Walker et al. | 418/152 |
| 4,708,210 | A * | 11/1987 | Rahm | 173/169 |
| 5,383,771 | A * | 1/1995 | Ghode et al. | 418/15 |
| 6,880,645 | B2 * | 4/2005 | Izumisawa | 173/93.5 |
| 7,886,840 | B2 | 2/2011 | Young et al. | |

* cited by examiner

*Primary Examiner* — F. Daniel Lopez
(74) *Attorney, Agent, or Firm* — Merchant & Gould P.C.

(57) ABSTRACT

A motor assembly for a pneumatic tool includes: a motor cylinder coaxially secured in a tubular inner housing, which is coaxially secured in a tubular outer housing and has an inlet passage defining a longitudinal axis, including a valve seat, and defining forward and reverse passages that communicate with a motor chamber and extend through the valve seat, and an exhaust port that communicates with the motor chamber, and a throttle passage defined between the inner and outer housings; a motor rotor supported within the motor chamber and rotatable in a forward or reverse direction; and a rotary valve coaxially disposed in the inner housing, supported by the valve seat, and rotatable about the longitudinal axis between forward and reverse positions.

6 Claims, 12 Drawing Sheets

MOTOR ASSEMBLY FOR PNEUMATIC TOOL

CROSS-REFERENCE TO RELATED APPLICATION

This application claims priority to Taiwanese Application No. 101117097, filed on May 14, 2012, the contents of which are hereby incorporated by reference.

BACKGROUND OF THE INVENTION

1. Field of the Invention

The invention relates to a motor assembly, and more particularly to a motor assembly for a pneumatic tool.

2. Description of the Related Art

FIGS. 1 and 2 illustrate a conventional motor assembly 1 for a pneumatic tool (not shown) disclosed in U.S. Pat. No. 7,886,840. The conventional motor assembly 1 includes an outer housing 11, a motor cylinder 12, a motor rotor 15, a rotary valve 13, a valve actuator 14, and an inlet bushing 16.

The outer housing 11 includes a rear housing 111 serving as a handle housing, and a front housing 112 that cooperates with the rear housing 111 to define an internal cavity in which the majority of the other elements of the motor assembly 11 are housed. The motor assembly 11 has a main axis (A). The motor cylinder 12, the motor rotor 15, the rotary valve 13, the valve actuator 14, and the inlet bushing 16 are arranged along the main axis (A) within the internal cavity in the outer housing 11.

The motor cylinder 12 includes a motor chamber portion 121 defining a motor chamber 120, and an inlet conduit portion 122 that has an inlet passage 1220 and a forward port 1221 communicating with each other and that is connected with the inlet bushing 16. The inlet passage 1220 communicates with a bushing passage 160 of the inlet bushing 16. The rear housing 111 of the outer housing 11 cooperates with the inlet conduit portion 122 of the motor cylinder 12 and the inlet bushing 16 to define an exhaust passage 114 thereamong. The motor chamber portion 121 of the motor cylinder 12 further defines a forward passage 123 and a reverse passage 124 that communicate with the motor chamber 120.

The motor rotor 15 is supported within the motor chamber 120, and is rotatable about the main axis (A) in response to flow of the motive fluid into the motor chamber 120 from the forward passage 123 or the reverse passage 124. The motor rotor 15 is connected to a work attachment (not shown) of the pneumatic tool such that the work attachment is operable to perform work in response to rotation of the motor rotor 15.

The rotary valve 13 is sleeved rotatably on the inlet conduit portion 122 of the motor cylinder 12, and is rotatable about the main axis (A). The rotary valve 13 has a valve passage 131 that communicates between the forward port 1221 of the inlet conduit portion 122 of the motor cylinder 12 and the forward passage 123 when the rotary valve 13 is located at a forward position and that communicate between a reverse port 1222 in the inlet conduit portion 122 of the motor cylinder 12 and the reverse passage 124 when the rotary valve 13 is located at a reverse position.

The valve actuator 14 has a head in sliding engagement with the front housing 112, and a stem that extends through the front housing 112 to engage the rotary valve 13 such that the head of the valve actuator 14 is slidable to cause movement of the rotary valve 14.

The following are some of the drawbacks of the conventional motor assembly 1:

1. Since the rotary valve 14 is sleeved on the inlet conduit portion 122 of the motor cylinder 12, the rear housing 111 for housing an assembly of the rotary valve 14 and the inlet conduit portion 122 has a relatively large outer diameter.

2. The inlet conduit portion 122 of the motor cylinder 12 is used to connect with the inlet bushing 16 to provide the inlet passage 1220. Thus, the inlet conduit portion 122 of the motor cylinder 12 is required to have a relatively long length along the main axis (A), thereby increasing production material and cost for manufacturing the motor cylinder 12.

3. Due to the presence of the relatively long input conduit portion 122, the conventional motor assembly 1 has a relatively long inlet path that consists of the bushing passage 160, the inlet passage 1220, the forward port 1221, and the valve passage 131, thereby resulting in increased kinetic energy loss due to flow of the motive fluid into the motor chamber 120.

SUMMARY OF THE INVENTION

Therefore, an object of the present invention is to provide a motor assembly for a pneumatic tool that can overcome the aforesaid drawbacks of the prior art.

According to the present invention, there is provided a motor assembly for use in a pneumatic tool. The motor assembly of the present invention comprises a housing unit, a motor cylinder, a motor rotor, a rotary valve, and a valve actuating unit.

The housing unit includes a tubular outer housing, and a tubular inner housing coaxially secured in the tubular outer housing. The tubular inner housing has an inlet passage that defines a longitudinal axis, and cooperates with the tubular outer housing to define a throttle passage therebetween.

The motor cylinder is coaxially secured in the tubular inner housing, and includes a valve seat that has a central axis collinear with the longitudinal axis. The motor cylinder defines a motor chamber, forward and reverse pas sages that communicate with the motor chamber and extend through the valve seat, and at least one exhaust port that communicates with the motor chamber and the throttle passage for flow of motive fluid from the motor chamber to the throttle passage.

The motor rotor is supported within the motor chamber in the motor cylinder for rotation about the longitudinal axis. The motor rotor is able to rotate in a forward direction in response to flow of the motive fluid into the motor chamber from the forward passage, and to rotate in a reverse direction opposite to the forward direction in response to flow of the motive fluid into the motor chamber from the reverse passage.

The rotary valve is coaxially disposed in the tubular inner housing of the housing unit, is supported by the valve seat of the motor cylinder, and has a valve passage. The rotary valve is rotatable relative to the valve seat of the motor cylinder about the longitudinal axis between a forward position, where the valve passage is placed in communication between the inlet passage in the tubular inner housing and the forward passage in the motor cylinder, and a reverse position, where the valve passage is placed in communication between the inlet passage in the tubular inner housing and the reverse passage in the motor cylinder.

The valve actuating unit is mounted movably to the housing unit, and is operable to actuate movement of the rotary valve between the forward and reverse positions.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 3:
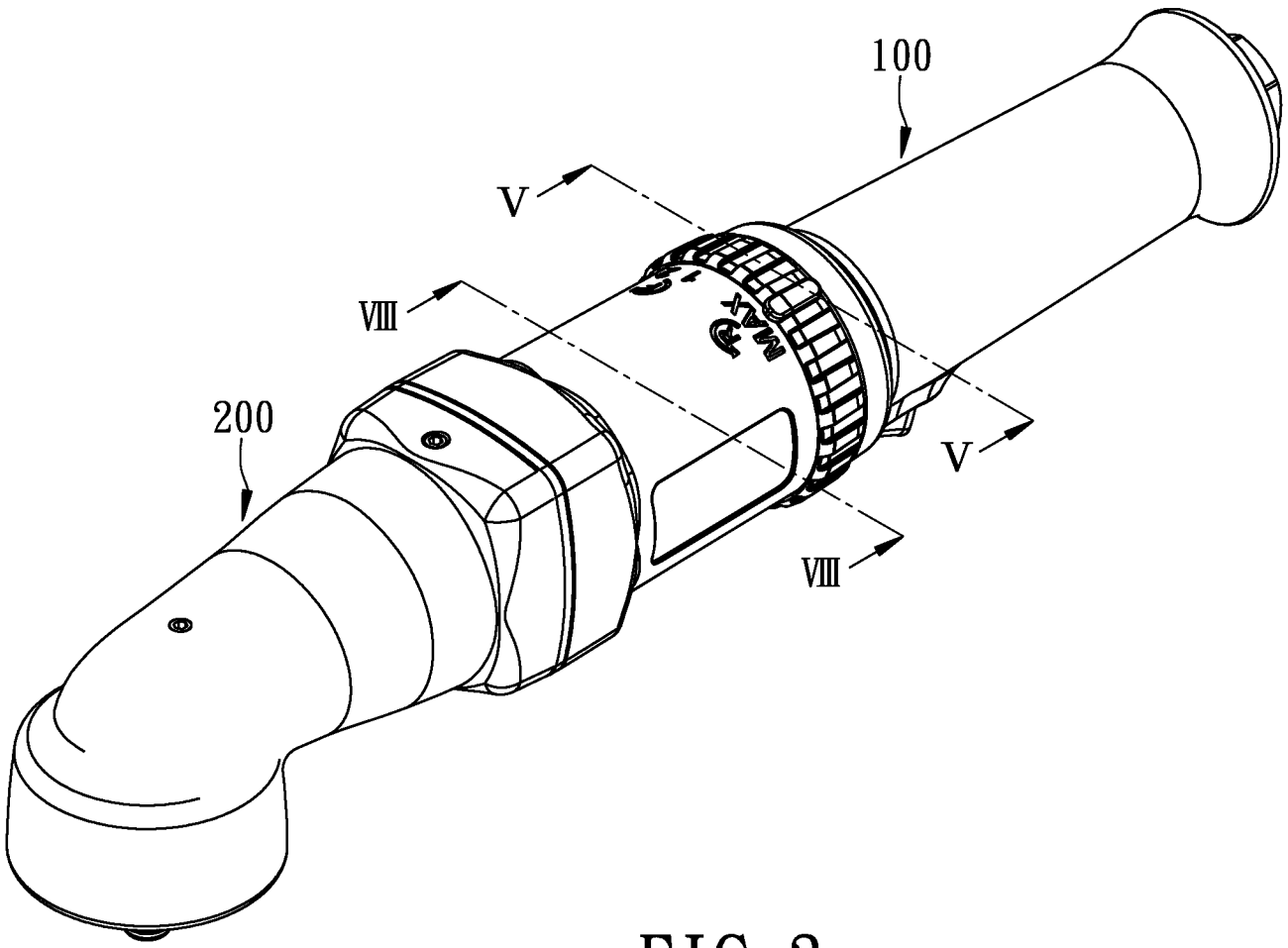
FIG. 3 is a perspective view showing a pneumatic tool employing the preferred embodiment of a motor assembly according to the present invention.
Figure 4:
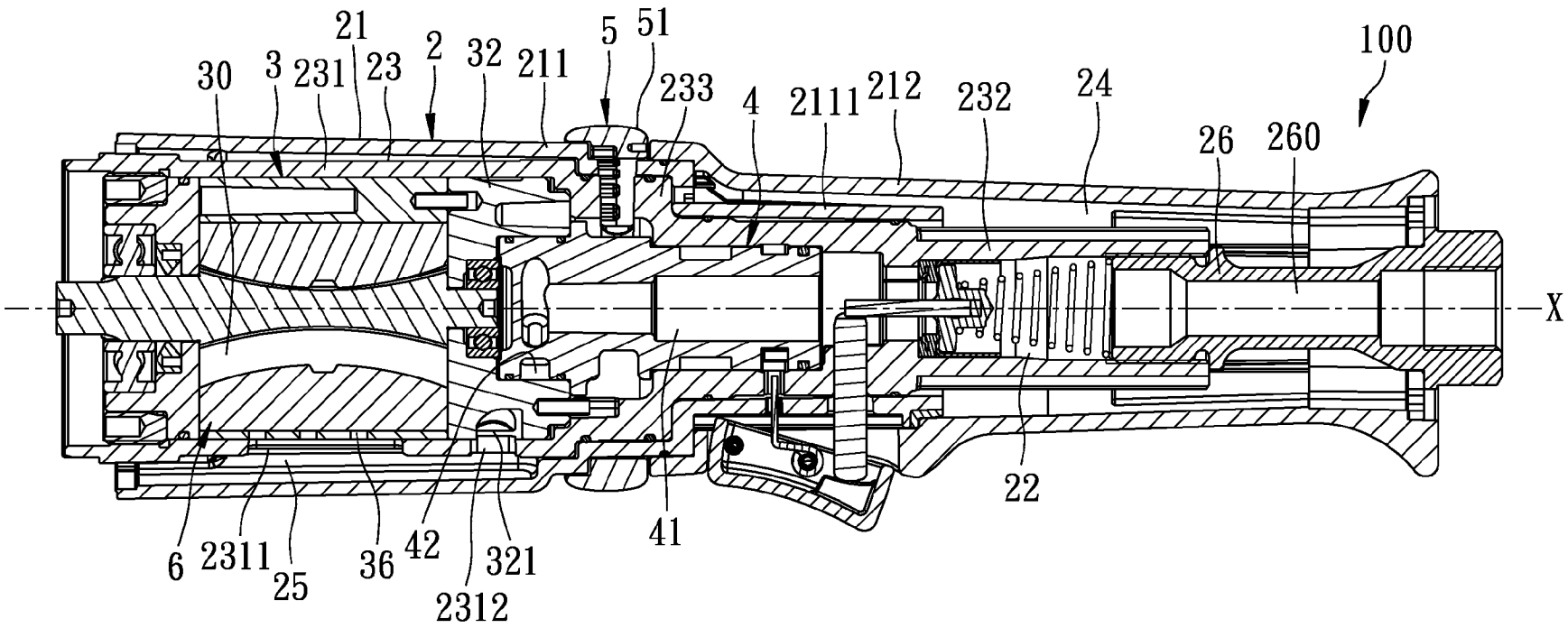
FIG. 4 is a schematic sectional view of the preferred embodiment.

FIG. 3 illustrates a pneumatic tool employing the preferred embodiment of a motor assembly 100 according to the present invention. The pneumatic tool includes a work attachment 200 connected to the motor assembly 100 and operable to perform work in response to a rotation output from the motor assembly 100. Referring to FIG. 4, the motor assembly 100 includes a housing unit 2, a motor cylinder 3, a motor rotor 6, a rotary valve 4, and a valve actuating unit 5.

Figure 4A:
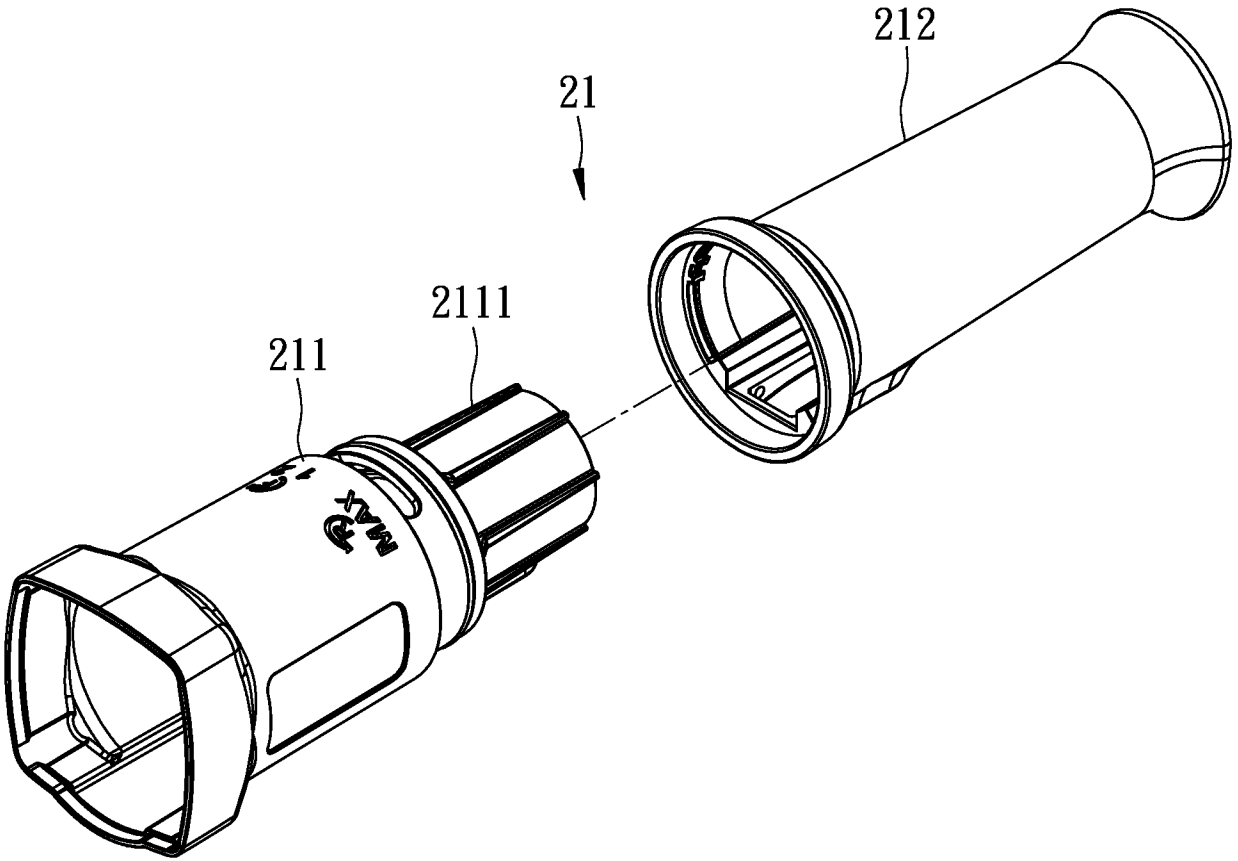
FIG. 4*a* is an exploded perspective view of an outer housing of the preferred embodiment.
Figure 4B:
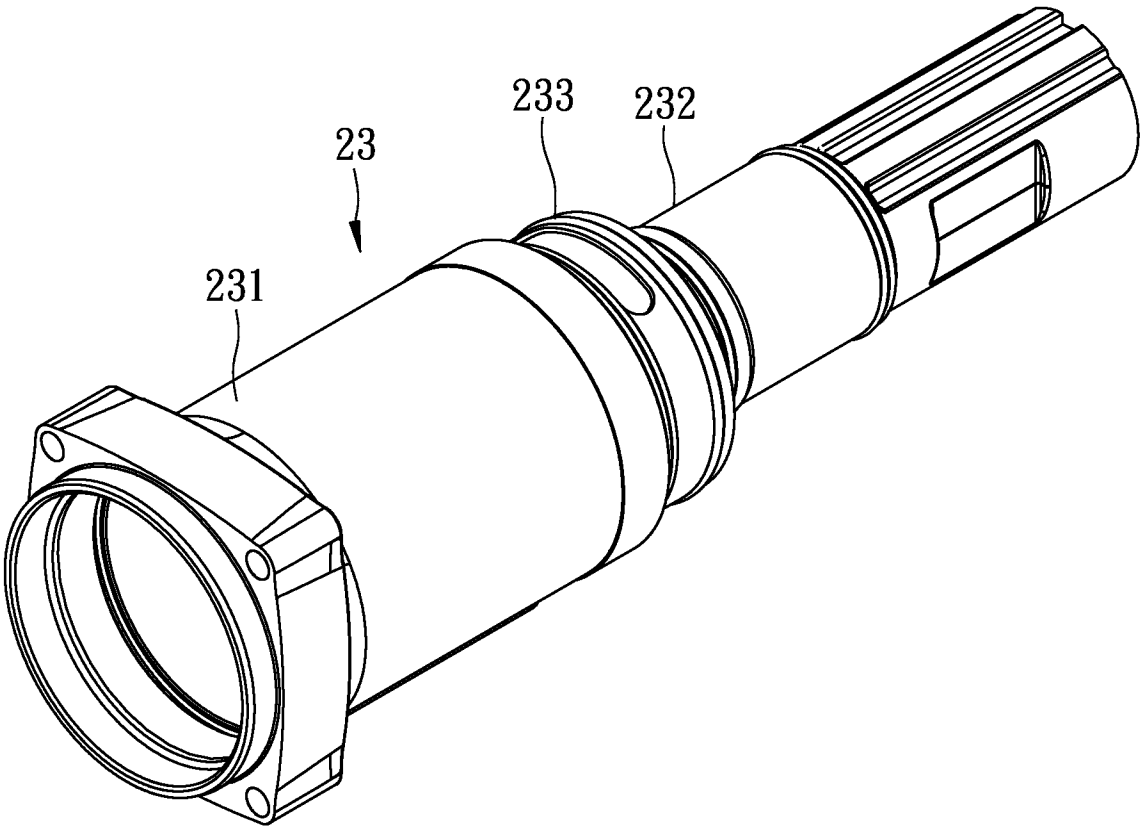
FIG. 4*b* is a perspective view of an inner housing of the preferred embodiment.

In this embodiment, the housing unit 2 includes a tubular outer housing 21, a tubular inner housing 23, and an inlet bushing 26. Referring further to FIGS. 4 and 4*a*, the outer housing 21 includes a first tube body 211, and a second tube body 212 connected with the first tube body 211. The first tube body 211 has an end portion 2111 extending into the second tube body 212. Referring further to FIGS. 4, 4*b*, 5, 8 and 9, the inner housing 23 is a unitary tube body, and is coaxially secured in the outer housing 21. The inner housing 23 has a largest-diameter portion 231, a smallest-diameter portion 232, and an intermediate portion 233 interconnecting the largest-diameter portion 231 and the smallest-diameter portion 232. The largest-diameter portion 231 and the intermediate portion 233 are surrounded by the first tube body 211 of the outer housing 21. The largest-diameter portion 231 of the inner housing 23 cooperates with the first tube body 211 of the outer housing 21 to define a throttle passage 25 therebetween (see FIGS. 4 and 8). The largest-diameter portion 231 of the inner housing 23 is formed with first and second slots 2311, 2312 that communicate with the throttle passage 25 (see FIG. 4). The smallest-diameter portion 232 is surrounded by the second tube body 212 of the outer housing 21, and cooperates with the second tube body 212 of the outer housing 21 to define an exhaust passage 24 therebetween. The smallest-diameter portion 232 has an inlet passage 22 that defines a longitudinal axis (X). The intermediate portion 233 has two interconnecting passages 27 (see FIG. 5) that extend in a direction parallel to the longitudinal axis (X) and that communicate with the exhaust passage 24, as best shown in FIG. 9. The inlet bushing 26 is coaxially secured in the second tube body 212 of the outer housing 21, and is connected with the smallest-diameter portion 232 of the inner housing 23. The inlet bushing 26 has a bushing passage 260 that communicates with the inlet passage 22 in the smallest-diameter portion 232 of the inner housing 23.

Figure 6:
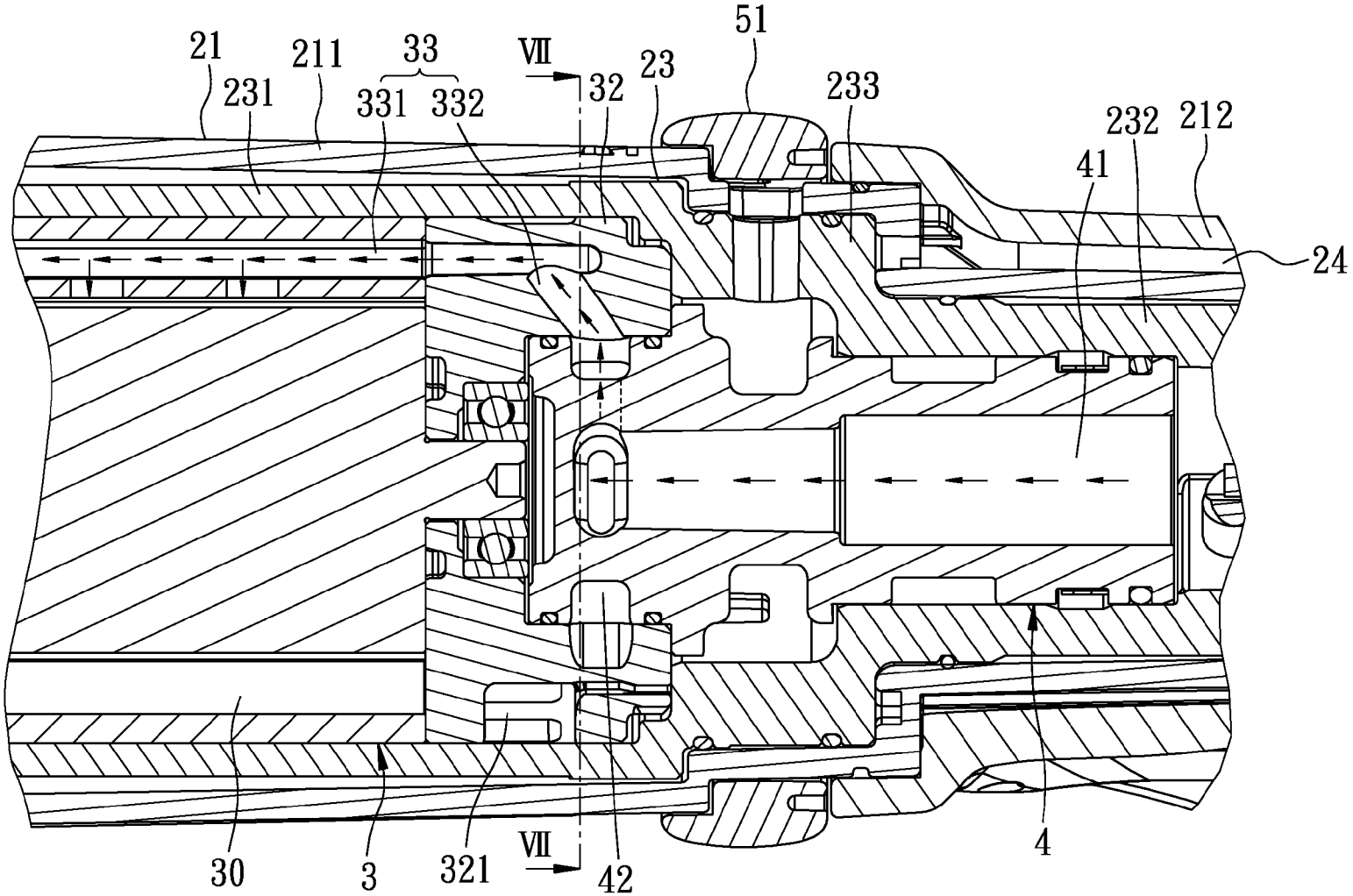
FIG. 6 is a fragmentary schematic sectional view of the preferred embodiment when a rotary valve is at a forward position.
Figure 7:
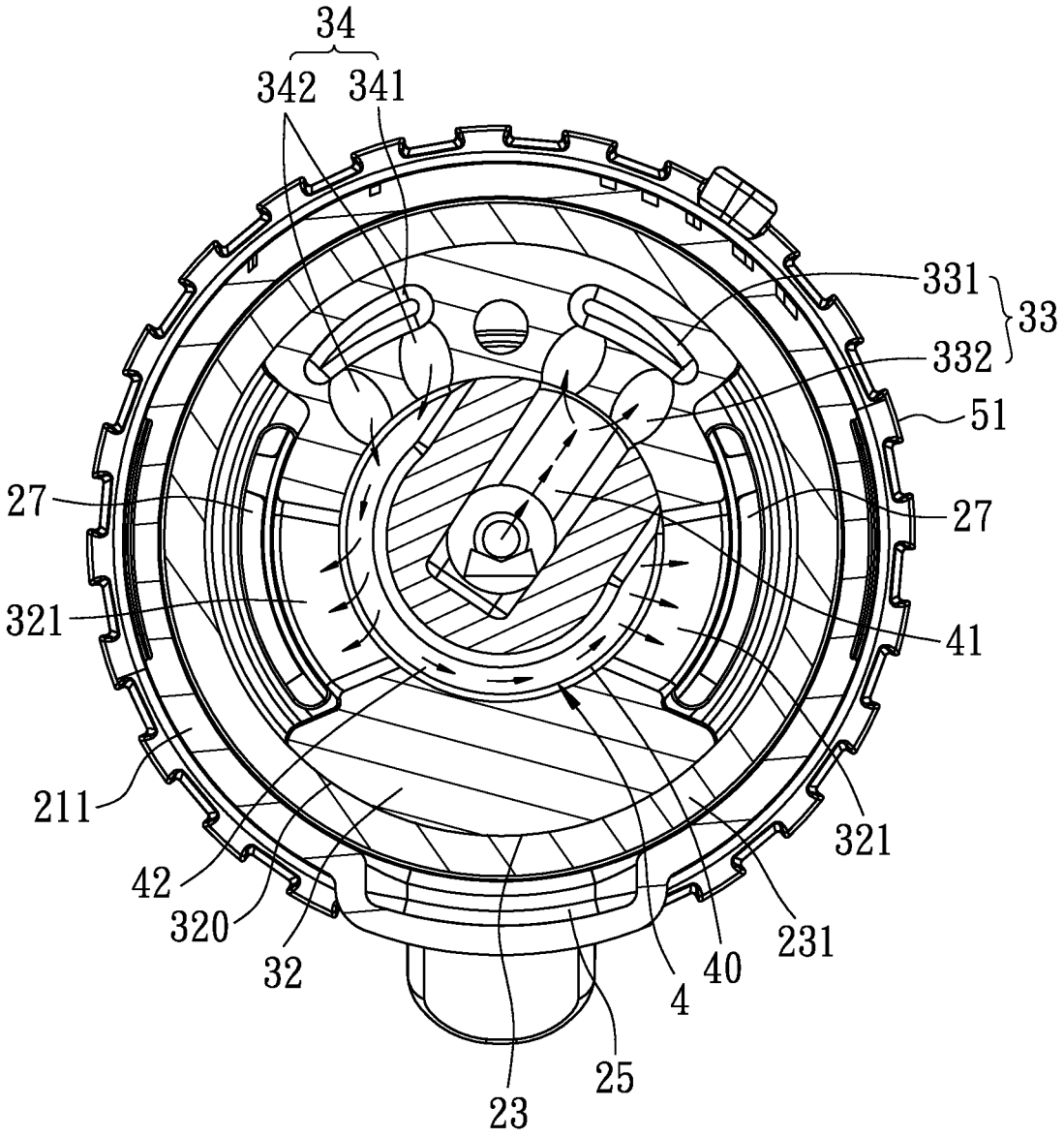
FIG. 7 is a schematic sectional view of the preferred embodiment taken along line VII-VII in FIG. 6.
Figure 8:
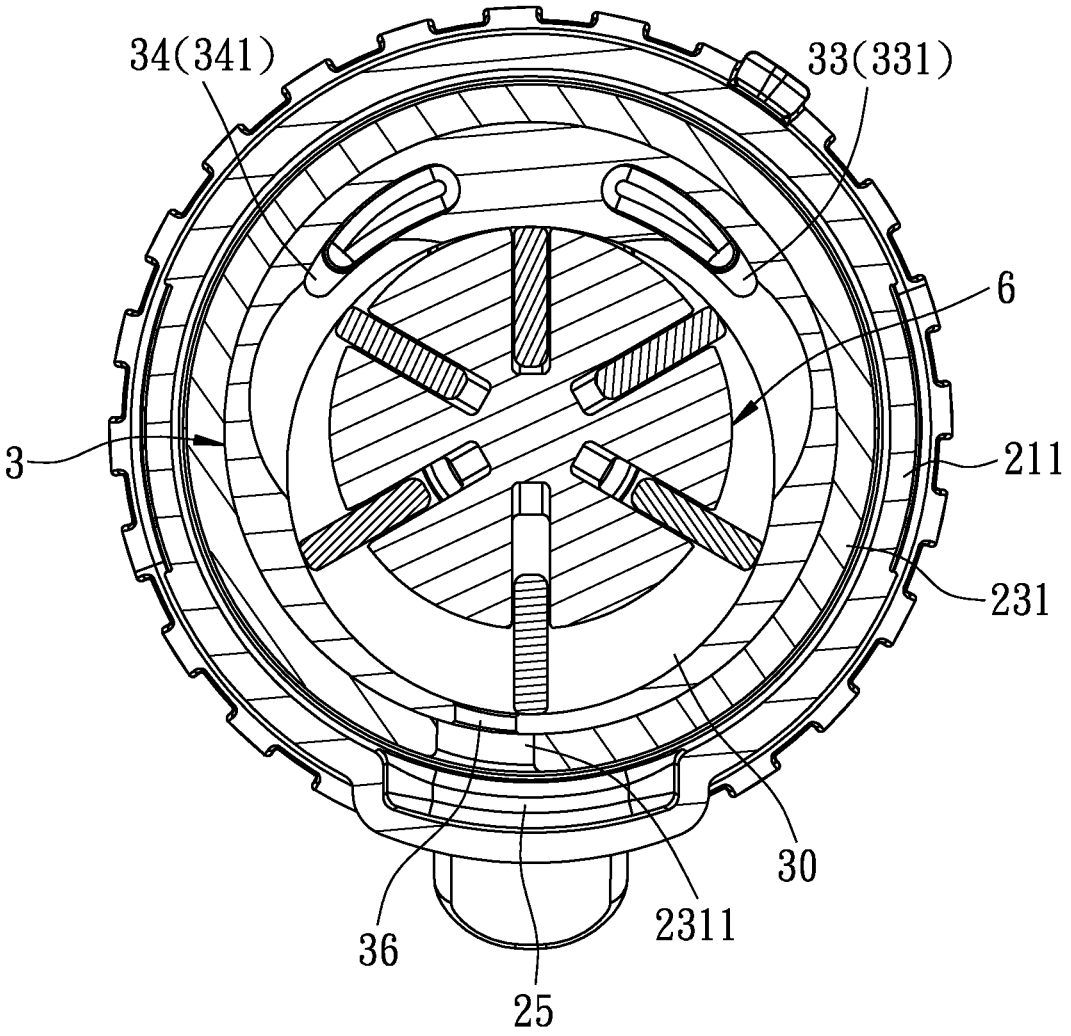
FIG. 8 is a schematic sectional view of the preferred embodiment taken along line VIII-VIII in FIG. 3.
Figure 9:
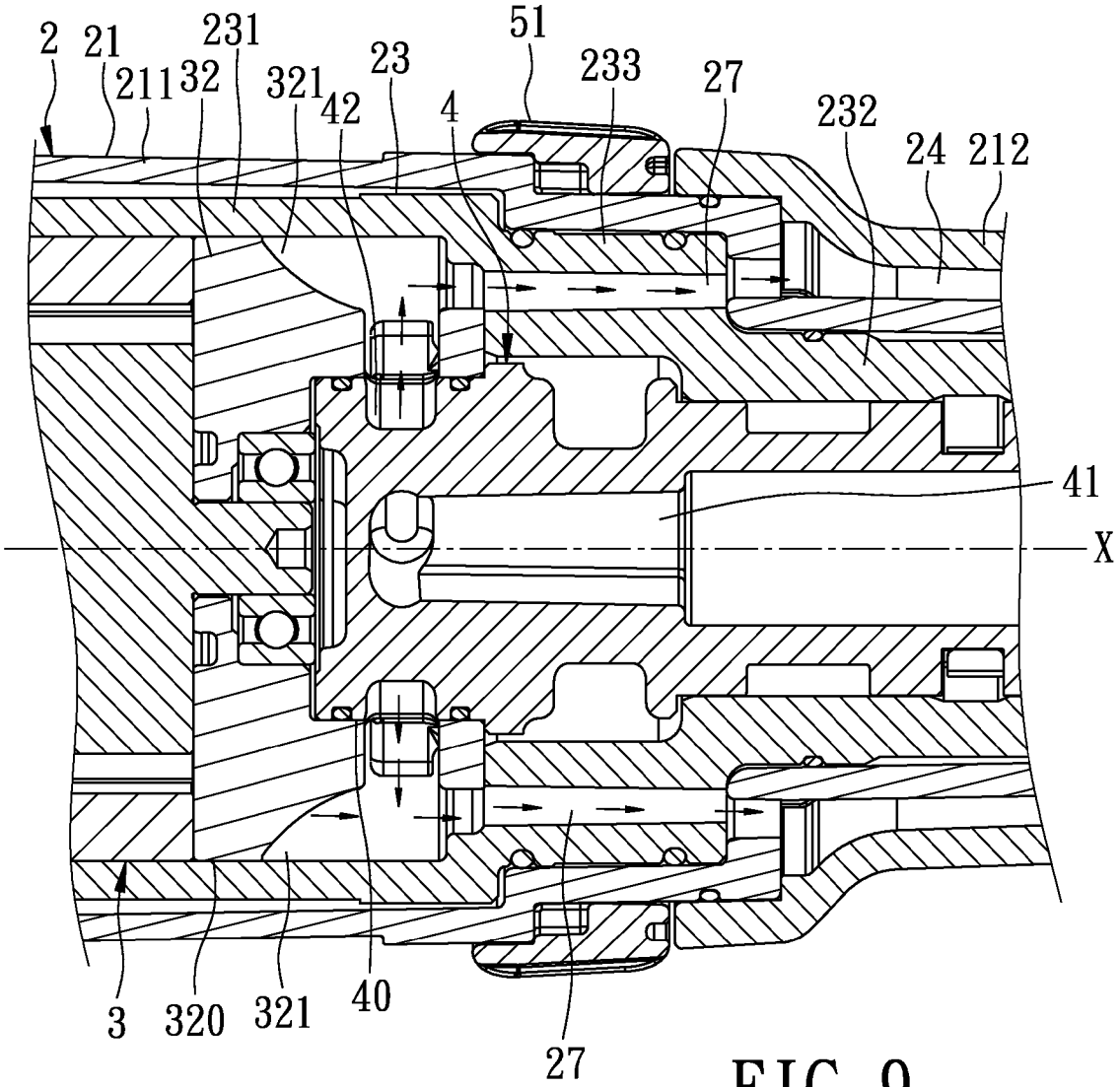
FIG. 9 is a fragmentary sectional view of the preferred embodiment illustrating flow of motive fluid from a motor chamber to an exhaust passage.

Referring further to FIGS. 4, 6, 7 and 8, the motor cylinder 3 is coaxially secured in the largest-diameter portion 231 of the inner housing 23 of the housing unit 2, and includes a valve seat 32 that is disposed adjacent to the intermediate portion 233 of the inner housing 23 and that has a central axis collinear with longitudinal axis (X). The motor cylinder 3 defines a motor chamber 30, a forward passage 33, a reverse passage 34, and a plurality of exhaust ports 36. The forward and reverse passages 33, 34 communicate with the motor chamber 30 and extend through the valve seat 32. With particular reference to FIGS. 6, 7, and 8, in this embodiment, the forward passage 33 in the motor cylinder 3 includes a first forward passage portion 331 communicating with the motor chamber 30, and two second forward passage portions 332 formed in the valve seat 32. Similar to the forward passage 33, the reverse passage 34 in the motor cylinder 3 includes a first reverse passage portion 341 communicating with the motor chamber 30, and two second reverse passage portions 342 formed in the valve seat 32. The valve seat 32 has an annular outer surface 320 formed with two openings 321 that communicate respectively with the interconnecting passages 27 in the intermediate portion 233 of the inner housing 23, as best shown in FIGS. 7 and 9. In addition, one of the openings 321 communicates with the throttle passage 25 through the second slot 2312 in the largest-diameter portion 231 of the inner housing 23 (see FIG. 4). Therefore, motive fluid can be exhausted from the motor chamber 30 to the exhaust passage 24 through the exhaust ports 36, the first slot 2311, the throttle passage 25, the second slot 2312, said one of the openings 321 and a respective one of the interconnecting passages 27.

Figure 4C:
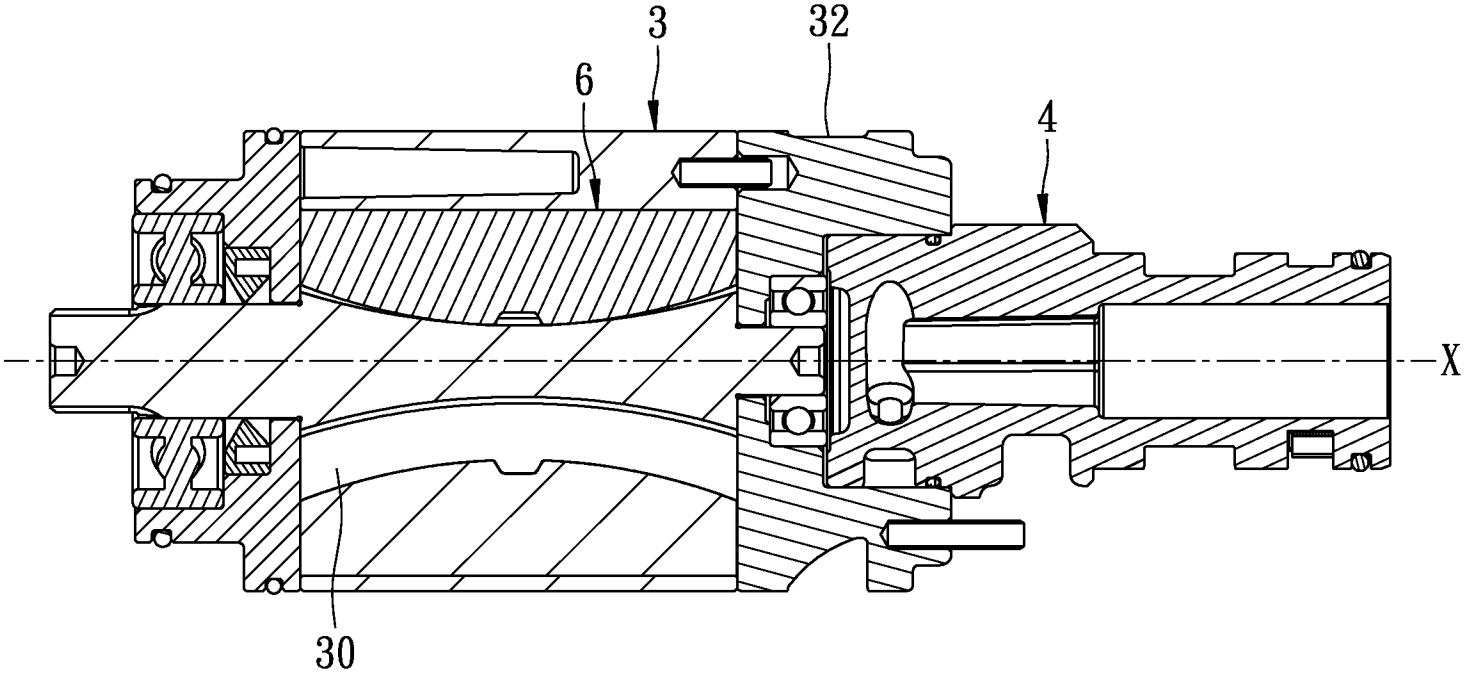
FIG. 4*c* is a schematic sectional view of an assembly of a motor cylinder, a motor rotor and a rotary valve of the preferred embodiment.

The motor rotor 6 is supported within the motor chamber 30 in the motor cylinder 3 for rotation about the longitudinal axis (X), as best shown in FIG. 4*c*. The motor rotor 6 is able to rotate in a forward direction in response to flow of the motive fluid into the motor chamber 30 from the forward passage 33, and to rotate in a reverse direction opposite to the forward direction in response to flow of motive fluid into the motor chamber 30 from the reverse passage 34.

With particular reference to FIGS. 6, 7 and 9, the rotary valve 4 is coaxially disposed in the inner housing 23 of the housing unit 2, and is supported by the valve seat 32 of the motor cylinder 3. The rotary valve 4 has a valve passage 41. The rotary valve 4 is rotatable relative to the valve seat 32 about the longitudinal axis (X) between a forward position, where the valve passage 41 is placed in communication between the inlet passage 22 in the smallest-diameter portion 232 of the inner housing 23 and the forward passage 33 in the motor cylinder 3 (see FIGS. 6 and 7), and a reverse position, where the valve passage 41 is placed in communication between the inlet passage 22 in the smallest-diameter portion 232 of the inner housing 23 and the reverse passage 34 in the motor cylinder 3. The rotary valve 4 has an annular outer surface 40 formed with an U-shaped groove 42 that communicates with the openings 321 in the rotary seat 32 (see FIGS. 7 and 9). When the valve passage 41 communicates with one of the forward and reverse passages 33, 34 in the motor cylinder 3, the other one of the forward and reverse passages 33, 34 in the motor cylinder 3 communicates with the U-shaped groove 42 in the annular outer surface 40 of the rotary valve 4.

More specifically, when the valve passage 41 of the rotary valve 4 communicates with the second forward passage portions 332 of the forward passage 33, the second reverse passage portions 342 of the reverse passage 34 communicate with the U-shaped groove 42 (see FIGS. 7 and 9). In this case, the motive fluid can flow into the motor chamber 30 through the bushing passage 260, the inlet passage 22, the valve passage 41, and the forward passage 33 such that the motor rotor 6 rotates in the forward direction in response to flow of the motive fluid into the motor chamber 30. Thereafter, the motive fluid is exhausted outside the housing unit 2 from the motor chamber 30 through a first exhaust path, which consists of the reverse passage 34, the U-shaped groove 42, the openings 321, the interconnecting passages 27 and the exhaust passage 24, and through a throttle path, which consists of the exhaust ports 36, the first slot 2311, the throttle passage 25, the second slot 2312, said one of the openings 321, i.e., the lower opening 321 in FIG. 9, the respective one of the interconnecting passages 27, i.e., a lower interconnecting passage 27 in FIG. 9, and the exhaust passage 24.

When the valve passage 41 of the rotary valve 4 communicates with the second reverse passage portions 342 of the reverse passage 34, the second forward passage portions 332 of the forward passage 33 communicate with the U-shaped groove 42. In this case, the motive fluid can flow into the motor chamber 30 through the bushing passage 260, the inlet passage 22, the valve passage 41, and the reverse passage 34 such that the motor rotor 6 rotates in the reverse direction in response to flow of the motive fluid into the motor chamber 30. Thereafter, the motive fluid is exhausted from the motor chamber 30 through a second exhaust path, which consists of the forward passage 33, the U-shaped groove 42, the openings 321, the interconnecting passages 27 and the exhaust passage 24, and through the throttle path.

Figure 5:
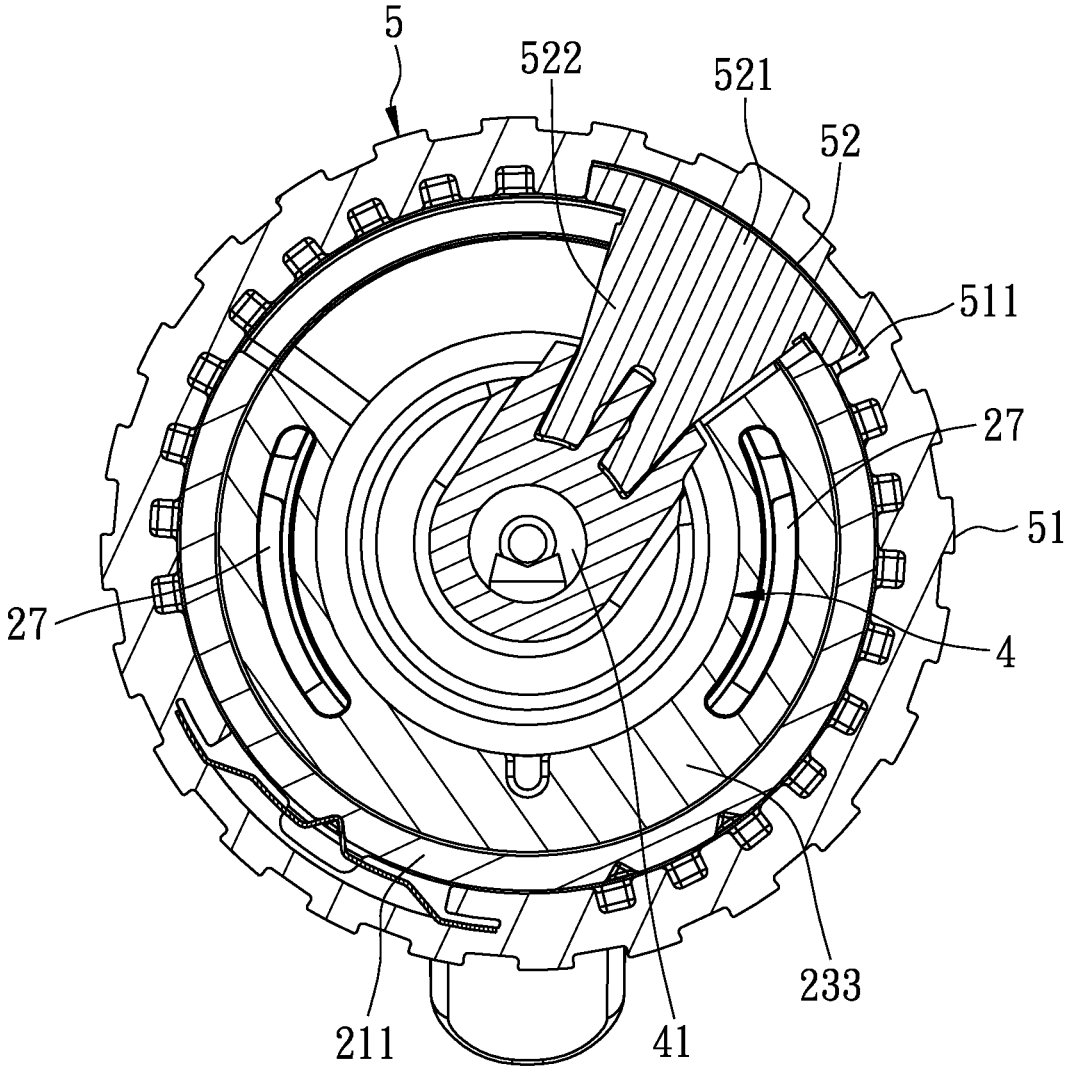
FIG. 5 is a schematic sectional view of the preferred embodiment taken along line V-V in FIG. 3.

The valve actuating unit 5 is mounted movably to the housing unit 2, and is operable to actuate rotation of the rotary valve 4 between the forward and reverse positions. With particular reference to FIGS. 4 and 5, in this embodiment, the valve actuating unit 5 includes an operating ring 51, and a valve actuator 52. The operating ring 51 is sleeved rotatably on the first tube body 211 of the outer housing 21 of the housing unit 2. The operating ring 51 has an annular inner surface formed with an engaging groove 511. The valve actuator 52 includes a head portion 521 mounted movably on the first tube body 211 of the outer housing 21 and in engagement with the engaging groove 511 in the operating ring 51, and a stem portion 522 integrally connected to the head portion 521 and extending through the first tube body 211 of the outer housing 21 and the intermediate portion 233 of the inner housing 23 to engage the rotary valve 4, such that the operating ring 51 relative to the outer housing 21 is rotatable about the longitudinal axis (X) to drive movement of said head portion 521 of the valve actuator 52 relative to the first tube body 211 of the outer housing 21, thereby causing rotation of the rotary valve 4 between the forward and reverse positions.

Figure 1:
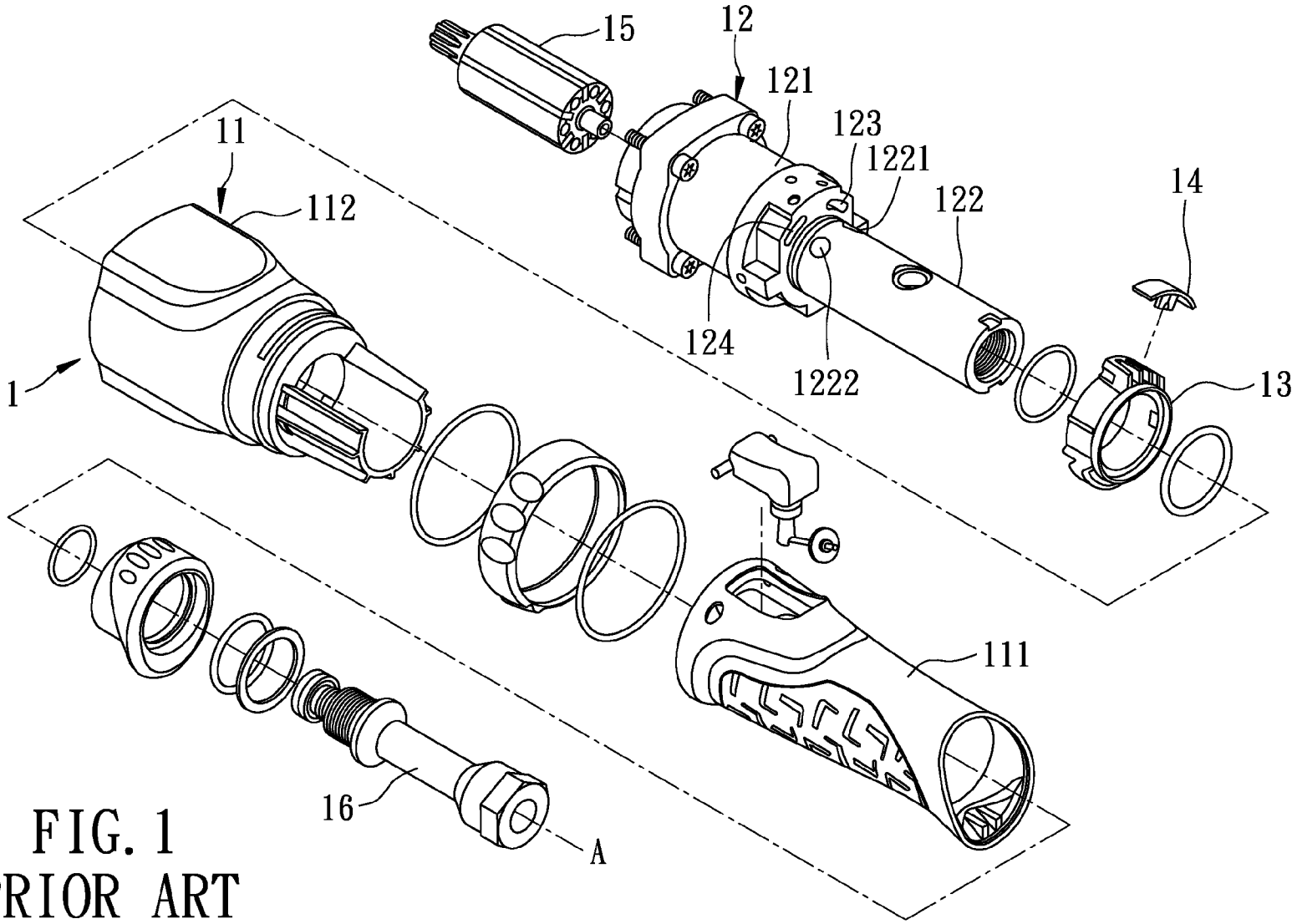
FIG. 1 PRIOR ART
FIG. 1 is an exploded perspective view of a conventional motor assembly.
Figure 2:
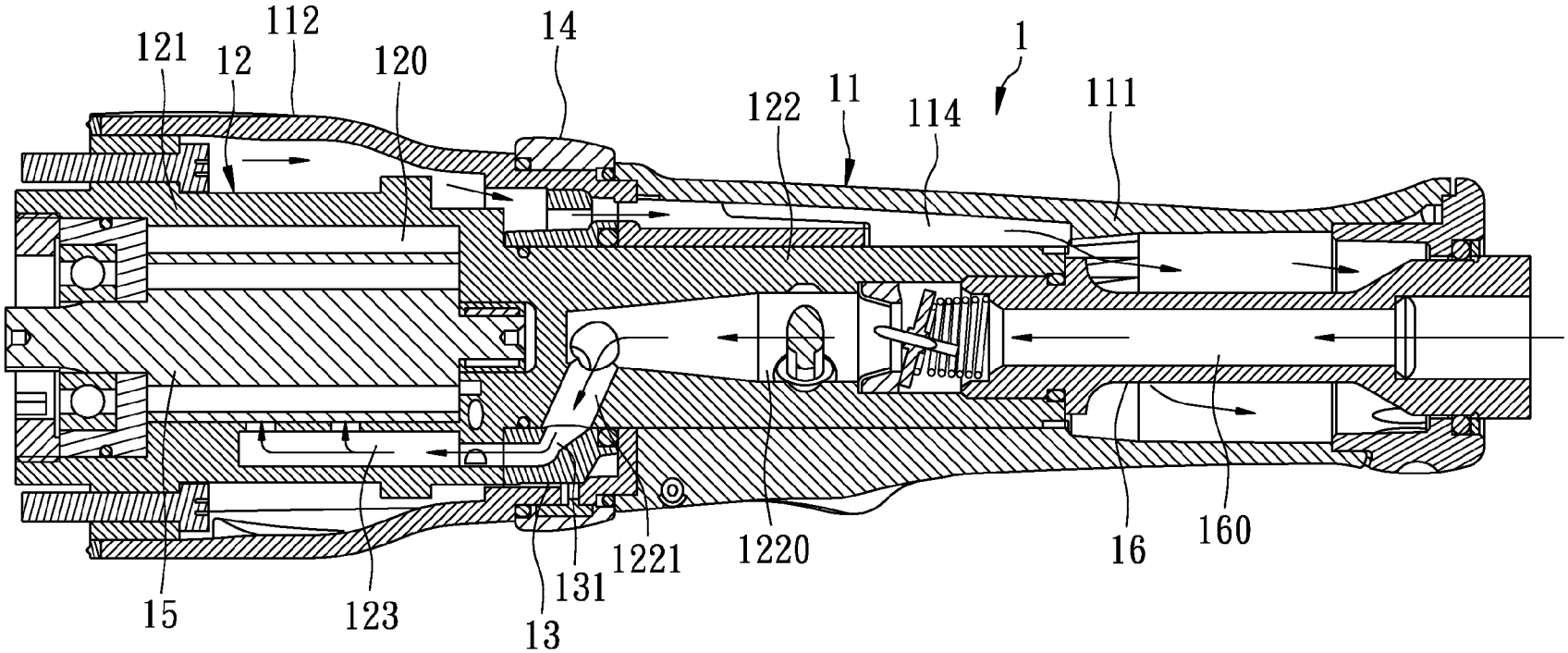
FIG. 2 PRIOR ART
FIG. 2 is a schematic sectional view of the conventional motor assembly.

In such a configuration, the rotary valve 4 is supported by the valve seat 32, and can be used to replace an assembly of the inlet conduit portion 122 and the rotary valve 13 of the conventional motor assembly 1 of FIG. 1. As a result, the motor cylinder 3 has a relatively short length in the direction parallel to the longitudinal axis (X). Therefore, product material and costs for manufacturing the motor cylinder 3 can be decreased. In addition, it is noted that the rotary valve 4 can be designed to be thinner and shorter. Thus, the second tube body 212 of the outer housing 21, which serves as a handle, can be made to have a smaller outer diameter. Therefore, the motor assembly 100 of the present invention can be manufactured at a lower cost as compared to the conventional motor assembly 1.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A motor assembly for use in a pneumatic tool, said motor assembly comprising:

a housing unit including a tubular outer housing, and a tubular inner housing coaxially secured in said tubular outer housing and having an inlet passage that defines a longitudinal axis, said tubular inner housing cooperating with said tubular outer housing to define a throttle passage therebetween;

a motor cylinder coaxially secured in said tubular inner housing, and including a valve seat that has a central axis collinear with the longitudinal axis, said motor cylinder defining a motor chamber, forward and reverse passages each of which communicates with said motor chamber, partially extends through said valve seat, and has at least one opening formed in an inner surrounding surface of said valve seat of said motor cylinder, and at least one exhaust port that communicates with said motor chamber and said throttle passage for exhaust of motive fluid from said motor chamber to said throttle passage;

a motor rotor supported within said motor chamber in said motor cylinder for rotation about the longitudinal axis, said motor rotor being able to rotate in a forward direction in response to flow of the motive fluid into said motor chamber from said forward passage, and to rotate in a reverse direction opposite to said forward direction in response to flow of the motive fluid into said motor chamber from said reverse passage;

a rotary valve coaxially disposed in said tubular inner housing of said housing unit, supported by said valve seat of said motor cylinder, and having a valve passage, said valve passage having a first section that extends along the longitudinal axis and that is in fluid communication with said inlet passage, and a second section that is in fluid communication with said first section, said second section of said valve passage having an opening that is formed in an outer surrounding surface of said rotary valve abutting against said inner surrounding surface of said valve seat of said motor cylinder, that is able to be in fluid communication with said opening of said forward passage or said opening of said reverse passage, and that is configured not to extend through an axial end surface of said rotary valve, said rotary valve being rotatable relative to said valve seat of said motor cylinder about the longitudinal axis between a forward position, where said valve passage is placed in communication between said inlet passage in said tubular inner housing and said forward passage in said motor cylinder, and a reverse position, where said valve passage is placed in communication between said inlet passage in said tubular inner housing and said reverse passage in said motor cylinder; and a valve actuating unit mounted movably to said housing unit and operable to actuate rotation of said rotary valve between the forward and reverse positions;

wherein said tubular inner housing of said housing unit is formed with a second slot that communicates with said throttle passage;

wherein said rotary valve has an annular outer surface formed with an U-shaped groove;

wherein, when said valve passage of said rotary valve communicates with one of said forward and reverse passages in said motor cylinder, the other one of said forward and reverse passages in said motor cylinder communicates with said U-shaped groove in said annular outer surface of said rotary valve; and wherein said valve seat of said motor cylinder has an annular outer surface formed with an opening that communicates with said second slot in said tubular inner housing and said U-shaped groove in said annular outer surface of said rotary valve.

2. The motor assembly as claimed in claim 1, wherein said tubular inner housing of said housing unit is formed with a first slot that communicates between said exhaust port in said motor cylinder and said throttle passage.

3. The motor assembly as claimed in claim 1, wherein:

said housing unit defines an exhaust passage between said tubular outer housing and said tubular inner housing; and said tubular inner housing of said housing unit includes an intermediate portion that surrounds said rotary valve, said intermediate portion being formed with at least one interconnecting passage that extends in a direction parallel to the longitudinal axis and that communicates between said opening in said valve seat of said motor cylinder and said exhaust passage.

4. The motor assembly as claimed in claim 1, wherein:

said forward passage in said motor cylinder includes a first forward passage portion communicating with said motor chamber, and at least one second forward passage portion formed in said valve seat;

said reverse passage in said motor cylinder includes a first reverse passage portion communicating with said motor chamber, and at least one second reverse passage portion formed in said valve seat;

when said valve passage of said rotary valve communicates with said second forward passage portion of said forward passage, said second reverse passage portion of said reverse passage communicates with said U-shaped groove in said annular outer surface of said rotary valve; and when said valve passage of said rotary valve communicates with said second reverse passage portion of said reverse passage, said second forward passage portion of said forward passage communicates with said U-shaped groove in said annular outer surface of said rotary valve.

5. The motor assembly as claimed in claim 1, wherein said valve actuating unit includes a valve actuator, said valve actuator including a head portion mounted movably on said tubular outer housing of said housing unit, and a stem portion connected to said head portion and extending through said tubular outer housing and said tubular inner housing to engage said rotary valve, such that said head portion of said valve actuator is movable relative to said tubular outer housing to cause rotation of said rotary valve between the forward and reverse positions.

6. The motor assembly as claimed in claim 5, wherein said valve actuating unit further includes an operating ring sleeved rotatably on said tubular outer housing of said housing unit and in engagement with said head portion of said valve actuator, such that said operating ring is rotatable relative to said tubular outer housing about the longitudinal axis to cause movement of said valve actuator.

* * * * *